US008436706B2

(12) United States Patent
Sathe et al.

(10) Patent No.: US 8,436,706 B2
(45) Date of Patent: May 7, 2013

(54) PUMPED LOOP REFRIGERANT SYSTEM FOR WINDINGS OF TRANSFORMER

(75) Inventors: Abhijit Ashok Sathe, Fort Wayne, IN (US); David Scott Gill, New Haven, IN (US); Robert Dale Thompson, Fort Wayne, IN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 13/266,538

(22) PCT Filed: May 26, 2010

(86) PCT No.: PCT/US2010/036128

§ 371 (c)(1), (2), (4) Date: Oct. 27, 2011

(87) PCT Pub. No.: WO2010/138540

PCT Pub. Date: Dec. 2, 2010

(65) Prior Publication Data

US 2012/0044032 A1 Feb. 23, 2012

Related U.S. Application Data

(60) Provisional application No. 61/181,126, filed on May 26, 2009.

(51) Int. Cl.
*H01F 27/08* (2006.01)
*H01F 27/10* (2006.01)

(52) U.S. Cl.
USPC ..... 336/62; 336/55; 336/57; 336/58; 336/61

(58) Field of Classification Search ..... 336/62, 336/55, 57, 58, 61; 174/15.1, 15.4, 16.1, 174/16.2, 68.1, 252
See application file for complete search history.

(56) References Cited

U.S. PATENT DOCUMENTS

| | | | | | |
|---|---|---|---|---|---|
| 1,794,606 | A | * | 3/1931 | Gebhard | 336/62 |
| 1,880,199 | A | * | 10/1932 | Gebhard et al. | 336/62 |
| 1,882,075 | A | * | 10/1932 | Gebhard | 336/62 |
| 2,292,946 | A | * | 8/1942 | Karig | 123/41.08 |
| 2,663,827 | A | * | 12/1953 | Baker | 336/62 |
| 2,774,807 | A | * | 12/1956 | Whitman | 174/15.1 |
| 2,825,033 | A | * | 2/1958 | Rudd et al. | 336/58 |
| 3,272,258 | A | * | 9/1966 | Bourquard | 165/259 |
| 3,306,350 | A | * | 2/1967 | Beurtheret | 165/104.27 |
| 3,371,298 | A | * | 2/1968 | Narbut | 336/57 |
| 4,173,996 | A | * | 11/1979 | Pierce | 165/104.27 |
| 4,276,530 | A | * | 6/1981 | Benke et al. | 336/58 |
| 4,350,838 | A | * | 9/1982 | Harrold | 174/15.1 |
| 4,692,560 | A | * | 9/1987 | Hotta et al. | 174/15.4 |
| 4,814,409 | A | * | 3/1989 | Blevins et al. | 528/25 |
| 4,874,916 | A | * | 10/1989 | Burke | 219/671 |
| 4,912,446 | A | * | 3/1990 | Singh et al. | 336/62 |
| 5,430,274 | A | * | 7/1995 | Couffet et al. | 219/677 |

* cited by examiner

*Primary Examiner* — Mohamad Musleh
*Assistant Examiner* — Joselito Baisa
(74) *Attorney, Agent, or Firm* — Thomas G. Fistek

(57) ABSTRACT

A pumped loop cooling system is provided to cool a hollow winding of a transformer utilizing a two phase vaporizable dielectric refrigerant. A liquid refrigerant pump circulates the refrigerant into a transformer and through a copper tube winding of the transformer where the refrigerant at least partially vaporizes in removing heat from the transformer. The refrigerant is then circulated to a condenser and then back to the pump.

17 Claims, 3 Drawing Sheets

PUMPED LOOP REFRIGERANT SYSTEM FOR WINDINGS OF TRANSFORMER

CROSS REFERENCE TO RELATED APPLICATIONS

The present application claims the benefit of the filing date of U.S. Provisional Patent Application Ser. No. 61/181,126, filed May 26, 2009, the disclosure of which is incorporated herein by reference in its entirety.

TECHNICAL FIELD

The present invention relates, in general, to a cooling system and method for cooling heat generating components, and in particular, to a vaporizable refrigerant cooling system for cooling a transformer with spiral windings.

BACKGROUND

Liquid cooled transformers are typically cooled by a dielectric fluid which fills the transformer housing. The fluid flows vertically up from the bottom of the housing and is heated by the windings. When the fluid reaches the top of the transformer windings, it exits the main tank and enters a series of radiators or cooling fins. It then flows downward through the radiators, where it is cooled, and re-enters the main tank.

SUMMARY

At least one embodiment of the invention provides a cooling system comprising: a condenser; at least one transformer having a spiral winding formed from a copper tube; at least one pump that pumps a vaporizable dielectric refrigerant through the spiral winding of the at least one transformer, to the condenser, and back to the at least one pump through a plurality of conduits.

At least one embodiment of the invention provides a cooling system comprising: a condenser; a liquid receiver; at least one transformer having a spiral winding formed from a copper tube; at least one liquid refrigerant pump; a vaporizable dielectric refrigerant circulated by the liquid refrigerant pump to the spiral winding of the transformer, whereby the refrigerant is at least partially evaporated by heat generated by the transformer, the at least partially evaporated refrigerant is circulated to the condensor where the refrigerant is condensed to a single liquid phase, whereby the liquid refrigerant is circulated to the liquid receiver and then returning to the pump.

BRIEF DESCRIPTION OF THE DRAWINGS

Embodiments of this invention will now be described in further detail with reference to the accompanying drawings, in which.

DETAILED DESCRIPTION

Figure 1:
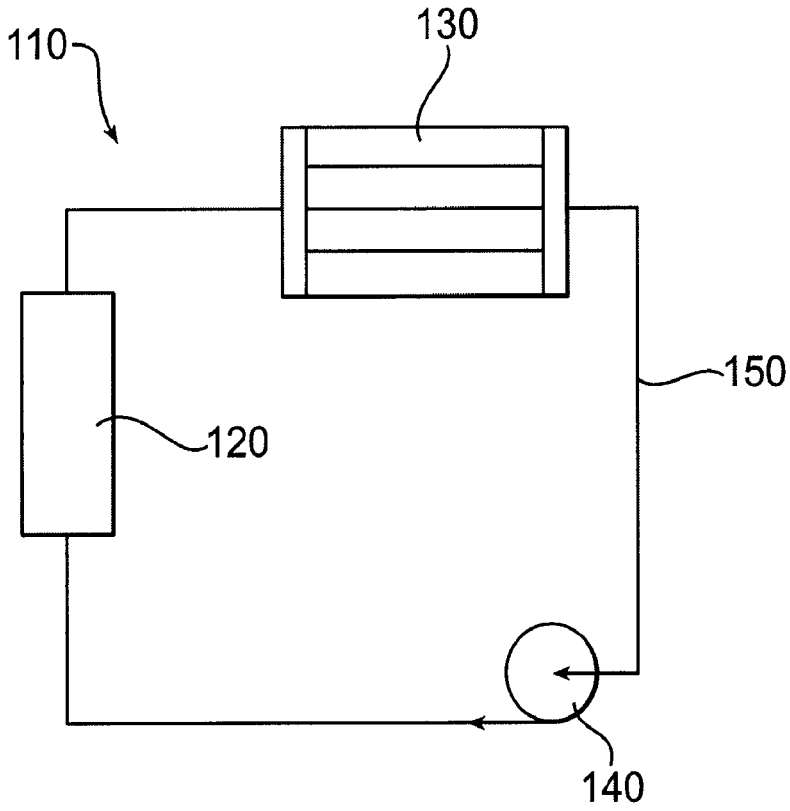
FIG. 1 (PRIOR ART)
FIG. 1 is a schematic diagram of a prior art pumped loop multiphase cooling system.

A prior art pumped liquid multiphase cooling system 110 is shown in FIG. 1 and comprises a cold plate/evaporator 120, a condenser 130 and a pump 140, connected to each other by fluid conduits 150. A fluid such as a two phase R134A refrigerant is pumped through the system 110 to cool an electronic component attached to the cold plate/evaporator 120. In the cold plate/evaporator 120, the heat generated by the electronic component is transferred to the fluid, causing the fluid to partially vaporize. The fluid then travels to the condenser 120 wherein the heat is rejected from the system 110 and the fluid returns to the cold plate/evaporator 120 by way of the pump 140. A pumped liquid multiphase system of this type is disclosed in U.S. Pat. Nos. 6,519,955 and 6,679,081, both incorporated herein by reference.

Figure 2:
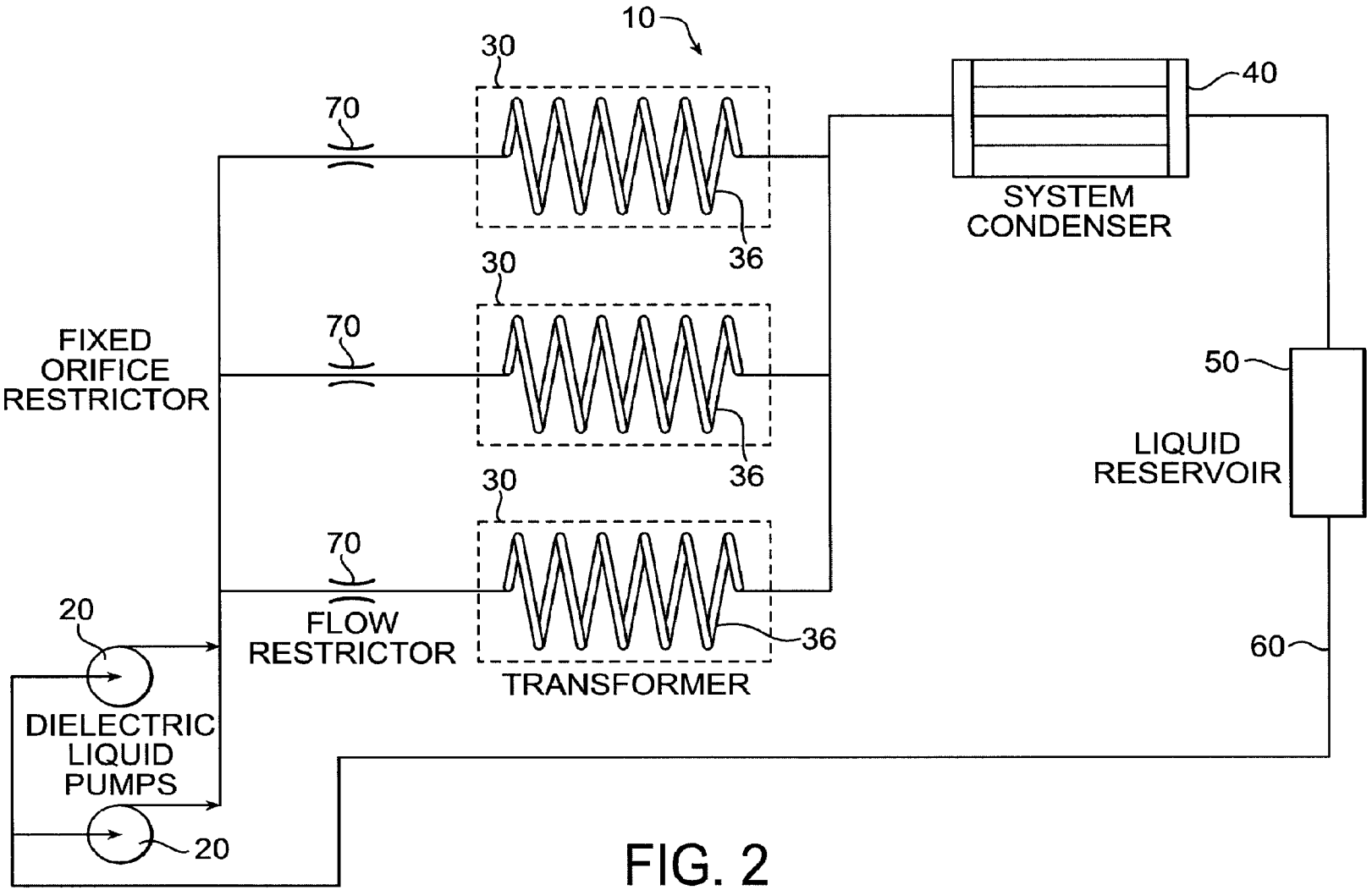
FIG. 2 is a schematic diagram of a pumped loop multiphase cooling system of a plurality of transformer coils in parallel utilizing fixed orifice restrictors.

An embodiment of a cooling system 10 of the present invention is shown in FIG. 2. The system 10 comprises at least one pump 20, at least one transformer 30 having a spiral winding 36, a condenser 40, and a liquid reservoir 50; the components connected to each other by various fluid conduits 60. The spiral winding 36 may be a primary or secondary winding of the transformer 30. A fluid such as a two phase R134A refrigerant is pumped through the system 10. The transformer spiral windings 36 are hollow copper tubing through which sub-cooled refrigerant is passed such that the spiral windings 36 act as an evaporator to cool the transformer 30. The refrigerant absorbs heat from the transformer windings 36 and exits the transformer 30 in a 2-phase state. The 2-phase refrigerant is then joined with the refrigerant manifold that sends it to the condenser 40 for rejecting the heat to ambient Appropriate fluid connections are used to fluidly connect the windings 36 to the system 10 while electrically isolating the windings 36 from the system 10 and from any other windings 36.

When more than one spiral winding 36 is used as an evaporator, the spiral windings may be in parallel to each other within the system 10. The cooling requirements of the transformers are predetermined and a fluid flow required to meet the cooling requirements can be provided by inserting fixed orifices 70 into the fluid conduit branches. The fixed orifices can be of any required diameter to ensure that the proper fluid flow is directed through the spiral winding evaporators 36 in a manner that the fluid is never completely evaporated across any spiral winding evaporators 36.

Figure 3:
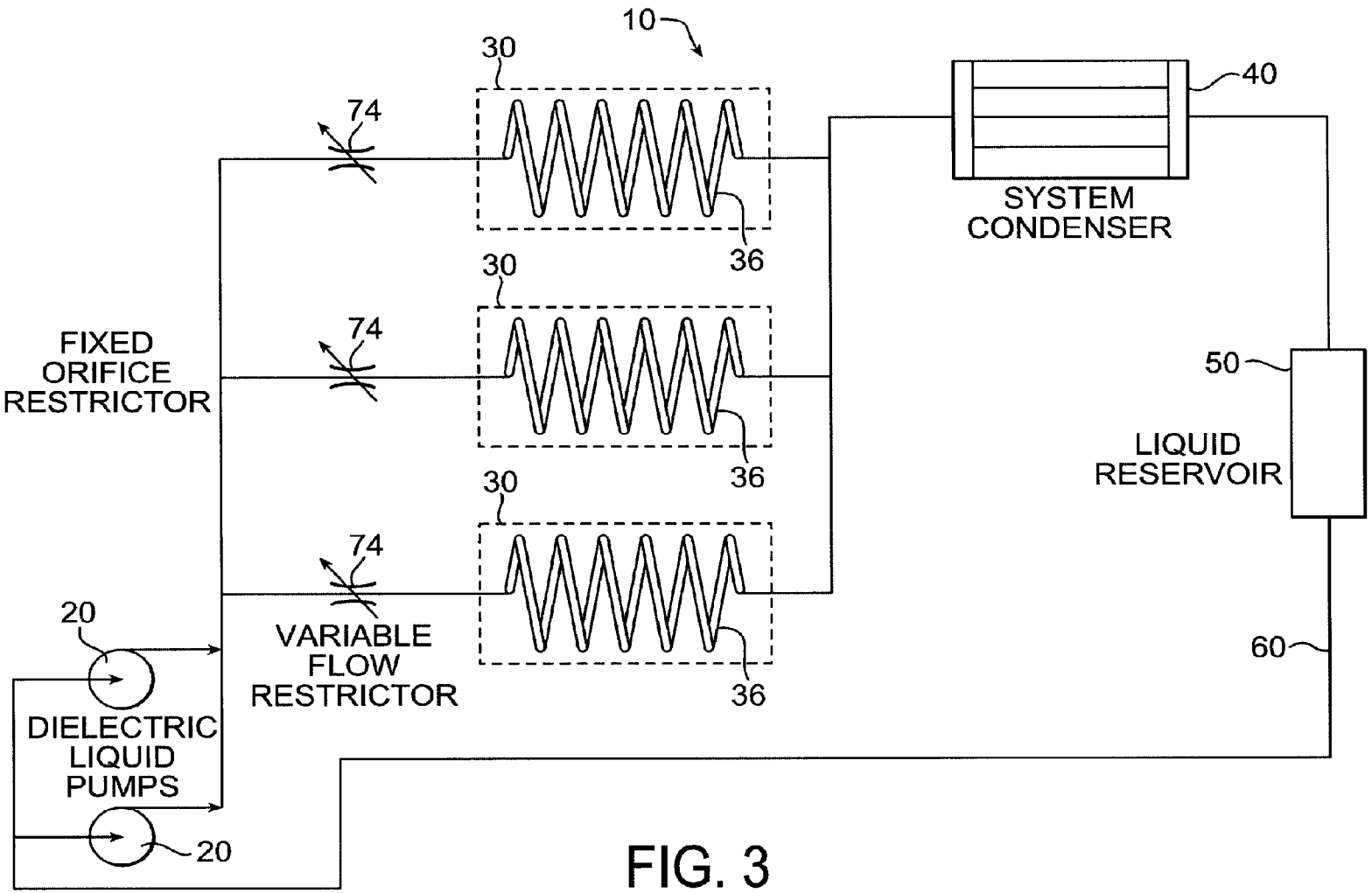
FIG. 3 is a schematic diagram of a pumped loop multiphase cooling system of a plurality of transformer coils in parallel utilizing variable orifice restrictors.

With fixed orifices, unexpected changes to the operating conditions of the system to be cooled may not be compensated for. Referring now to FIG. 3, the fixed orifices in FIG. 2 have been replaced by adjustable flow restrictors 74. Adjustable flow restrictors 74 can react to changes in the operating conditions of the system to be cooled to increase or decrease the fluid flow through the adjustable flow restrictors 74. The adjustable flow restrictors 74 may be a variable orifice restrictor, a needle valve, or any other flow metering device that has the ability to change the fluid flow through the restrictor in response to physical conditions at the restrictor.

The adjustment of the fluid flow may also be accomplished using sensed pressure and/or temperature data either at the restrictor or based on feedback using sensed data from the outlet side of the evaporators Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. A cooling system comprising:

a condenser;

a first electrical component having a spiral winding formed from a tube and a second electrical component having a spiral winding formed from a tube, the spiral winding of the first electrical component and the spiral winding of the second electrical component fluidly positioned in parallel to each other within the system;

at least one pump that pumps a vaporizable dielectric refrigerant through the spiral winding of the first electrical component and the spiral winding of second electrical component, to the condenser, and back to the at least one pump through a plurality of conduits; and a first flow restrictor positioned upstream the spiral winding of the first electrical component that provides a flow rate of refrigerant to the spiral winding that ensures that the refrigerant does not completely evaporate in the spiral winding; and a second flow restrictor positioned upstream the spiral winding of the second electrical component that provides a flow rate of refrigerant to the spiral winding that ensures that the refrigerant does not completely evaporate in the spiral winding.

2. The cooling system of claim 1, further comprising a liquid receiver positioned between the condenser and the at least one pump.

3. The cooling system of claim 1, wherein at least one of the flow restrictors is a fixed orifice restrictor.

4. The cooling system of claim 1, wherein at least one of the flow restrictors is an adjustable orifice restrictor.

5. The cooling system of claim 1, wherein the spiral winding of at least one of the electrical components is a primary winding of the electrical component.

6. The cooling system of claim 1, wherein the spiral winding of at least one of the electrical components is a secondary winding of the electrical component.

7. The cooling system of claim 1, wherein the first electrical component is a first transformer and the second electrical component is a second transformer.

8. The cooling system of claim 7, wherein the tube of the first transformer is a copper tube, and the tube of the second transformer is a copper tube.

9. The cooling system of claim 1, further comprising a third electrical component having a spiral winding formed from a tube, the spiral winding of the third electrical component fluidly positioned in parallel to the spiral winding of the first electrical component and the spiral winding of the second electrical component, wherein the at least one pump pumps refrigerant through the spiral winding of the third electrical component and to the condenser through a plurality of additional conduits; and a third flow restrictor positioned upstream from the spiral winding of the third electrical component that provides a flow rate of refrigerant to the spiral winding ensuring that the refrigerant does not completely evaporate in the spiral winding.

10. A cooling system comprising:

a condenser;

a liquid receiver;

a first electrical component having a spiral winding formed from a tube and a second electrical component having a spiral winding formed from a tube, the spiral winding of the first electrical component and the spiral winding of the second electrical component fluidly positioned in parallel to each other within the system;

at least one liquid refrigerant pump;

a vaporizable dielectric refrigerant circulated by the liquid refrigerant pump to the spiral winding of the first electrical component and to the spiral winding of the second electrical component, whereby the refrigerant is at least partially evaporated by heat generated by the electrical components, the at least partially evaporated refrigerant is circulated to the condenser where the refrigerant is condensed to a single phase liquid, and the single phase liquid refrigerant is circulated to the liquid receiver and then returned to the pump;

a first flow restrictor positioned upstream from the spiral winding of the first electrical component that provides a flow rate of refrigerant to the spiral winding ensuring that the refrigerant does not completely evaporate in the spiral winding; and a second flow restrictor positioned upstream from the spiral winding of the second electrical component that provides a flow rate of refrigerant to the spiral winding ensuring that the refrigerant does not completely evaporate in the spiral winding.

11. The cooling system of claim 10, wherein at least one of the flow restrictors is a fixed orifice restrictor.

12. The cooling system of claim 10, wherein at least one of the flow restrictors is an adjustable orifice restrictor.

13. The cooling system of claim 10, wherein the spiral winding of at least one of the electrical components is a primary winding of the electrical component.

14. The cooling system of claim 13, wherein the spiral winding of at least one of the electrical components is a secondary winding of the electrical component.

15. The cooling system of claim 10, wherein the first electrical component is a first transformer and the second electrical component is a second transformer.

16. The cooling system of claim 15, wherein the tube of the first transformer is a copper tube, and the tube of the second transformer is a copper tube.

17. The cooling system of claim 10, further comprising a third electrical component having a spiral winding formed from a tube, the spiral winding of the third electrical component fluidly positioned in parallel to the spiral winding of the first electrical component and the spiral winding of the second electrical component, wherein the at least one liquid refrigerant pump circulates refrigerant through the spiral winding of the third electrical component, whereby the refrigerant is at least partially evaporated by heat generated by the third electrical component, the at least partially evaporated refrigerant is circulated to the condenser where the refrigerant is condensed to a single phase liquid, and the single phase liquid refrigerant is circulated to the liquid receiver and then returned to the pump; and a first flow restrictor positioned upstream from the spiral winding of the third electrical component that provides a flow rate of refrigerant to the spiral winding ensuring that the refrigerant does not completely evaporate in the spiral winding.

* * * * *